United States Patent [19]

Hall

[11] 4,443,130

[45] Apr. 17, 1984

[54] REMOTELY OPERATED TOOL FOR PERFORMING FUNCTIONS UNDER WATER

[75] Inventor: Douglas D. Hall, Houston, Tex.

[73] Assignee: Armco Inc., Middletown, Ohio

[21] Appl. No.: 330,671

[22] Filed: Dec. 14, 1981

[51] Int. Cl.[3] ..... B63C 11/52; E21B 23/04

[52] U.S. Cl. ..... 405/190; 166/340; 166/342; 294/86.15

[58] Field of Search ..... 405/190, 191, 166, 168, 405/169, 195; 166/342, 338, 340; 285/3, 306; 294/66 R, 66 A, 86.15, 88

[56] References Cited

U.S. PATENT DOCUMENTS 3,268,239 8/1966 Castor ..... 166/237

3,302,709 2/1967 Postlewaite ..... 166/340

3,695,350 10/1972 Petersen ..... 166/342 X 3,709,291 1/1973 Hanes ..... 405/191

3,987,741 10/1976 Tryon ..... 405/191 X

*Primary Examiner*—Ernest R. Purser

*Attorney, Agent, or Firm*—Roylance, Abrams, Berdo & Goodman

[57] ABSTRACT

Remotely operated tool for performing functions at underwater installations. Tools according to the invention are especially useful for remote retrieval and installation of wireline bushings in hollow guide posts. Particularly advantageous embodiments of the tool are fluid pressure operated, include means for performing at least two functions, successively, and respond to a single pressure fluid input rather than requiring successive inputs.

18 Claims, 19 Drawing Figures

FIG. 1
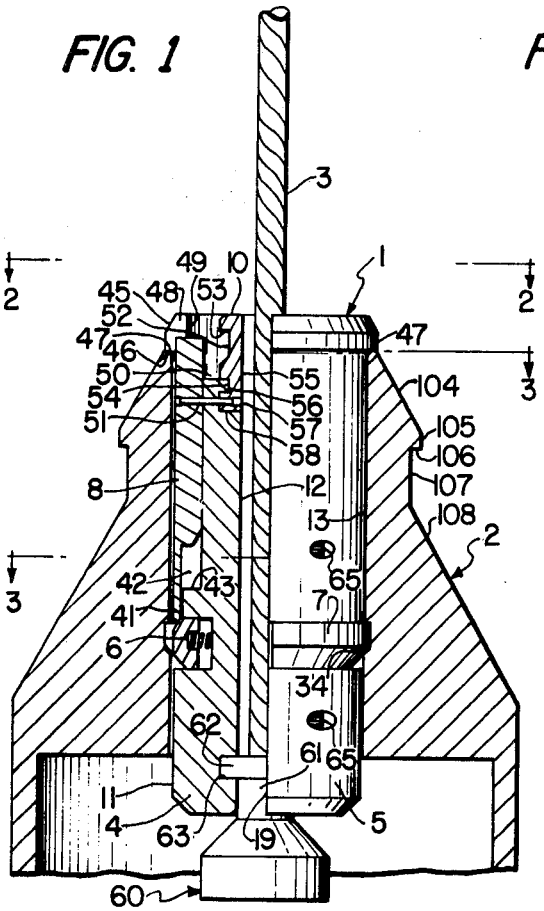
FIG. 2
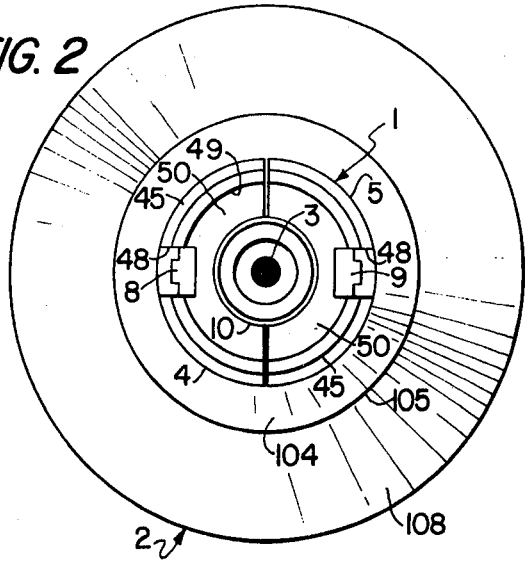
FIG. 3
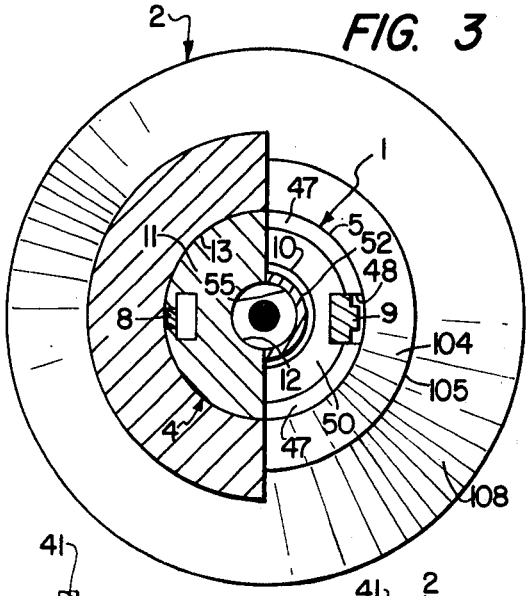
FIG. 4
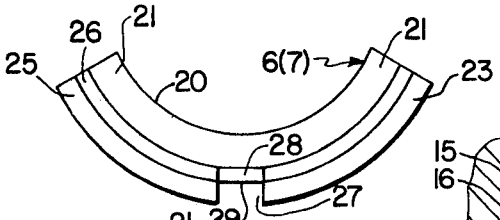
FIG. 5
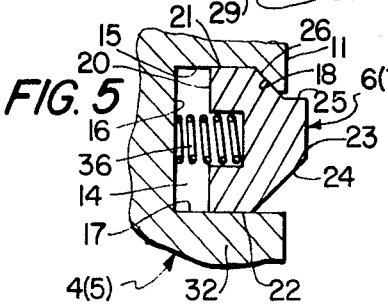
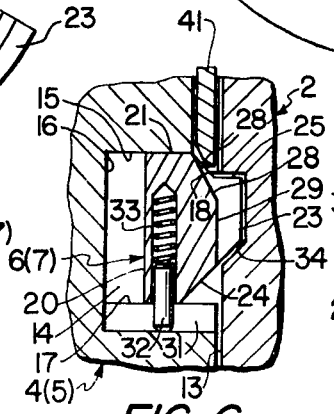
FIG. 6
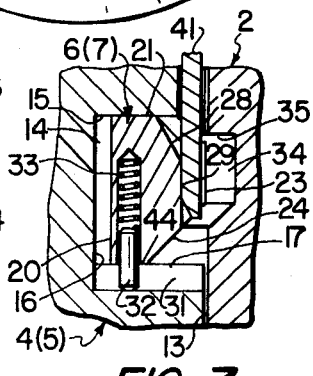
FIG. 7

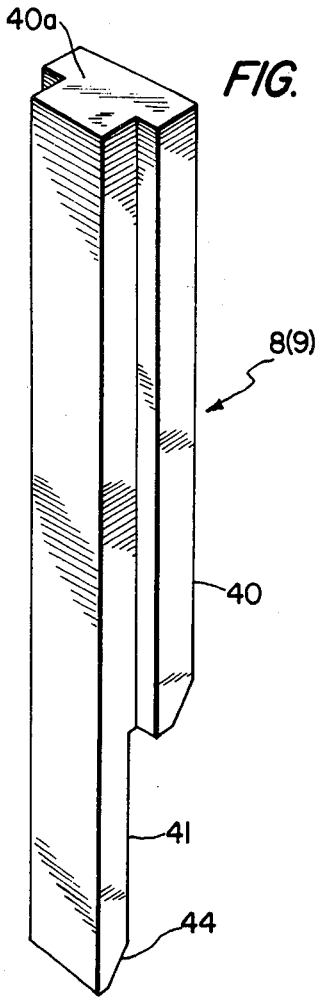
FIG. 8
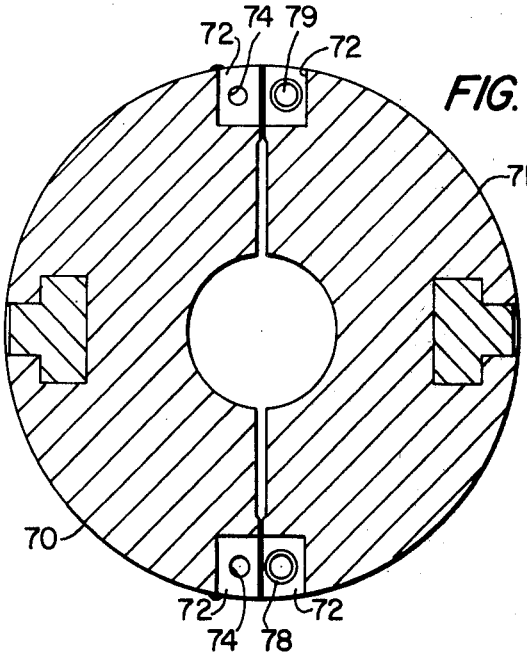
FIG. 9
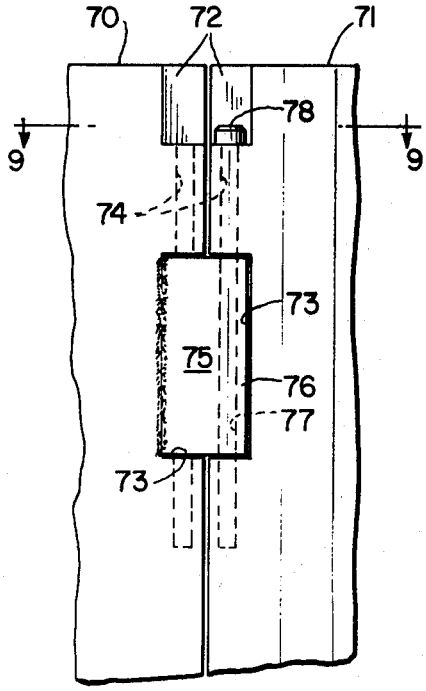
FIG. 10
FIG. 16
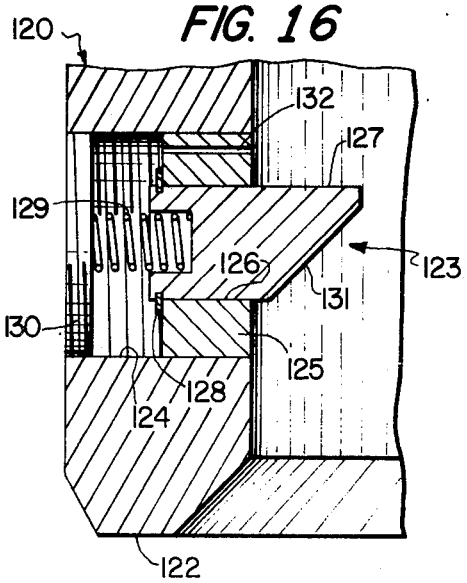

FIG. 11
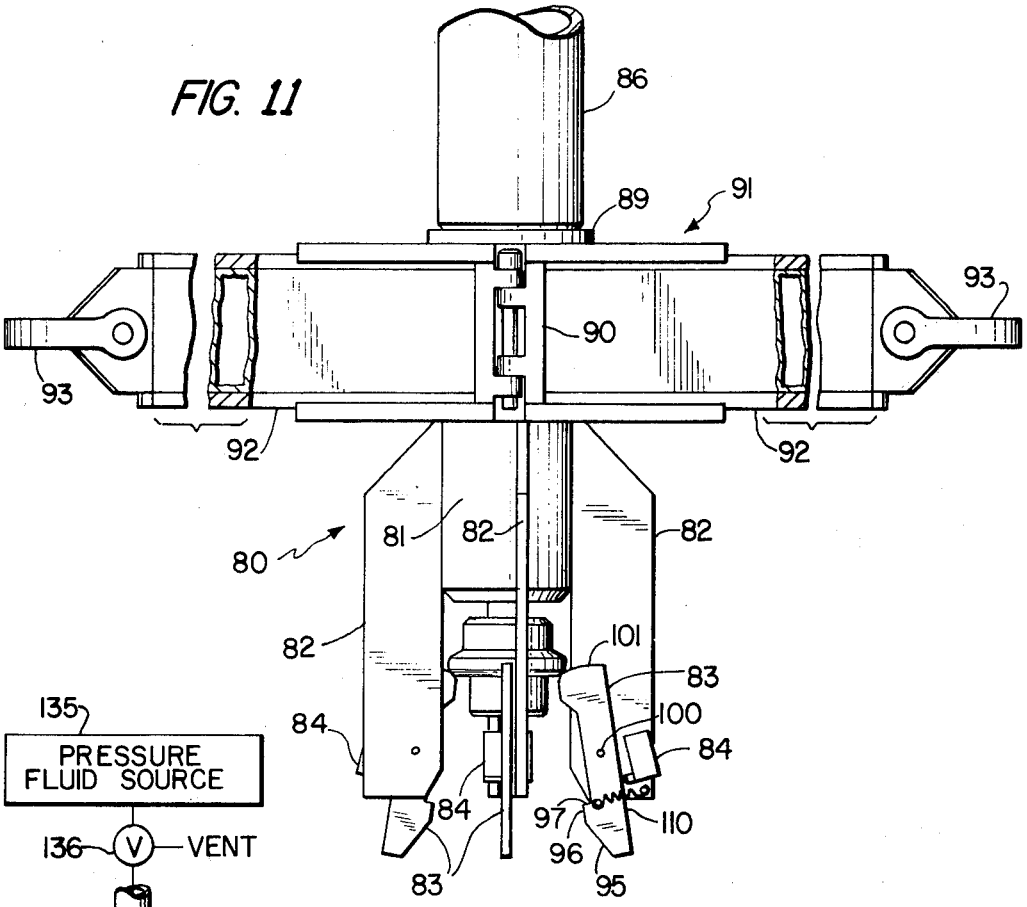
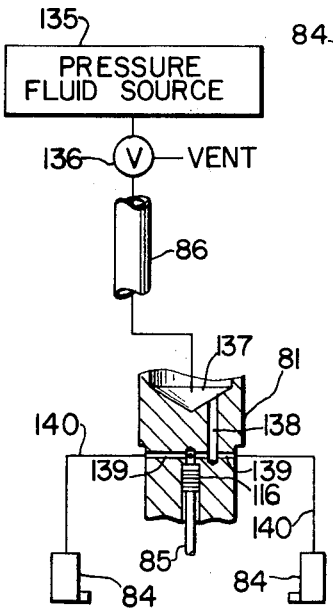
FIG. 19

REMOTELY OPERATED TOOL FOR PERFORMING FUNCTIONS UNDER WATER

This application relates to remotely operated tools for performing tasks under water. While useful for other purposes, tools according to the invention are specially effective for retrieving and installing the guide post bushings of guidance systems of the type employed in establishing offshore oil and gas wells.

RELATED APPLICATION

The guide post bushing disclosed in this application is disclosed and claimed in my copending U.S. patent application Ser. No. 330,725, filed concurrently herewith, which application is incorporated herein by reference.

BACKGROUND OF THE INVENTION

In the offshore oil and gas well art, it is frequently necessary to accomplish a task or tasks, by remote operations carried out from a platform or other operational base at the water surface, with relation to a device which has been installed in a location at, e.g., the floor of the body of water. With the depth of the installation beyond that range in which diver assistance is practical, such tasks are usually accomplished by use of a remotely operated handling tool lowered and manipulated by a handling string. In many cases, the device installed under water is of substantial size, so that provision for automatic grasping of the device by a handling tool is relatively uncomplicated, and since the device is frequently disposed well within the relatively large bore of, e.g., a wellhead body, location of the handling tool on landing of the tool is relatively simple and easy to achieve remotely with precision. See, for example, the tools disclosed in U.S. Pat. No. 3,240,511, issued Mar. 15, 1966, to Bishop et al for retrieving casing hangers, seal devices and the like. In other cases, as in cutting a guide line immediately adjacent the top of a guide post when the guide line has been broken, the problem of properly positioning the tool preparatory to cutting becomes more complex. See U.S. Pat. No. 3,709,291, issued Jan. 9, 1973, to Hanes et al. When the task to be accomplished involves removal of a device, such as a guide line bushing in a hollow guide post, more severe problems are presented, since the handling tool must extend within the post or other hollow member in order to engage the device on which the task is to be performed, and the bore in which the device is disposed is frequently of relatively small diameter and positioning of the handling tool must be accomplished with relative precision before being operated to engage the device.

While remotely operated handling tools of the type described are available to the trade, there has been a continuing need for improvement of such tools. On the one hand, there is a need for reducing the size, complexity and weight of the tool but, on the other hand, there is a need to achieve more precise location of the tool automatically as it is landed and greater certainty that the tool will perform in the intended fashion when responding to a remotely supplied control function.

OBJECTS OF THE INVENTION

A general object of the invention is to provide a handling tool of the type described which is less complex than prior-art tools, yet more dependable in operation.

Another object is to devise such a tool which can be used to accomplish tasks within the relatively small bore of a hollow member when the wall of the small bore cannot be used to center the tool relative to the bore.

A further object is to provide such a tool which can be operated remotely to accomplish a plurality of tasks in response to a single control input.

Yet another object is to provide a tool capable of extracting a device, such as a wireline bushing, from a hollow member, with the tool having two extracting modes, for redundancy, plus the capability of being retrieved for re-use in the event that extraction of the device cannot be accomplished.

A still further object is to provide a device in which a first movable member, to perform a first function, and a second movable member, to accomplish another function, are powered by fluid pressure operated devices in parallel to the same pressure fluid source, and one of the movable members is prevented from operating until the other has been operated.

SUMMARY OF THE INVENTION

Handling tools according to the invention comprise a tool body capable of being guided under water, as by a guide arm unit cooperating with the guide lines of a conventional guidance system. The body is equipped with locator means to engage a socket member, such as the top of a hollow guide post, and center the tool body with respect to the socket member. First movable power-operated means, typically a set of jaw members for gripping the socket member, are carried by the body and operatively disposed relative to the locator means. The tool body also carries second movable power-operated means operatively arranged relative to the locator means, the second power-operated means typically being a retrieving member or a running member constructed and arranged to be engaged with a device, such as a wireline bushing, to be handled by the tool. The arrangement is such that the tool can be guided to the socket member and landed with respect thereto, the first power-operated means then being actuated to, e.g., grasp the socket member, and the second power-operated means then being actuated to, e.g., unlatch and connect to a device, such as a wireline bushing, in the socket member.

Advantageously, the two power-operated means are operated by pressure fluid and are connected to the same source of pressure fluid in parallel, and the first power operated means is so constructed and arranged as to block operation of the second power-operated means until the first poweroperated means has operated.

IDENTIFICATION OF THE DRAWINGS

In the drawings, which form a part of the original disclosure of this application, FIG. 1, is a vertical sectional view, with some parts shown in side elevation, of a bushing capable of being retrieved and installed by handling tools according to the invention installed in the top of a hollow guide post and serving to position and anchor a wire guide line;

FIGS. 2 and 3 are transverse sectional views taken generally on lines 2—2 and 3—3, FIG. 1, respectively;

FIG. 4 is a top plan view of a latch member two of which are employed in the bushing of FIG. 1;

FIG. 5 is a fragmentary vertical sectional view taken through one end portion of one of the latch members and the adjacent portions of the bushing member which carries the latch member;

FIGS. 6 and 7 are sectional views similar to FIG. 5 but taken at the mid-point of the latch member and showing different positions of a plunger which coacts with the latch member;

FIG. 8 is a perspective view of one of the plungers employed in the bushing of FIG. 1;

FIGS. 9 and 10 are fragmentary transverse sectional and side elevational views, respectively, of another form of bushing which can be handled by tools according to the invention;

FIG. 11 is a side elevational view of a guide frame and handling tool according to one embodiment of the invention;

FIG. 16 is a vertical sectional view of a spring biased shear pin employed in the handling tool of FIGS. 11–15;

FIG. 19 is a diagram illustrating the pressure fluid circuits for the tool.

DETAILED DESCRIPTION OF THE INVENTION

Figure 12:
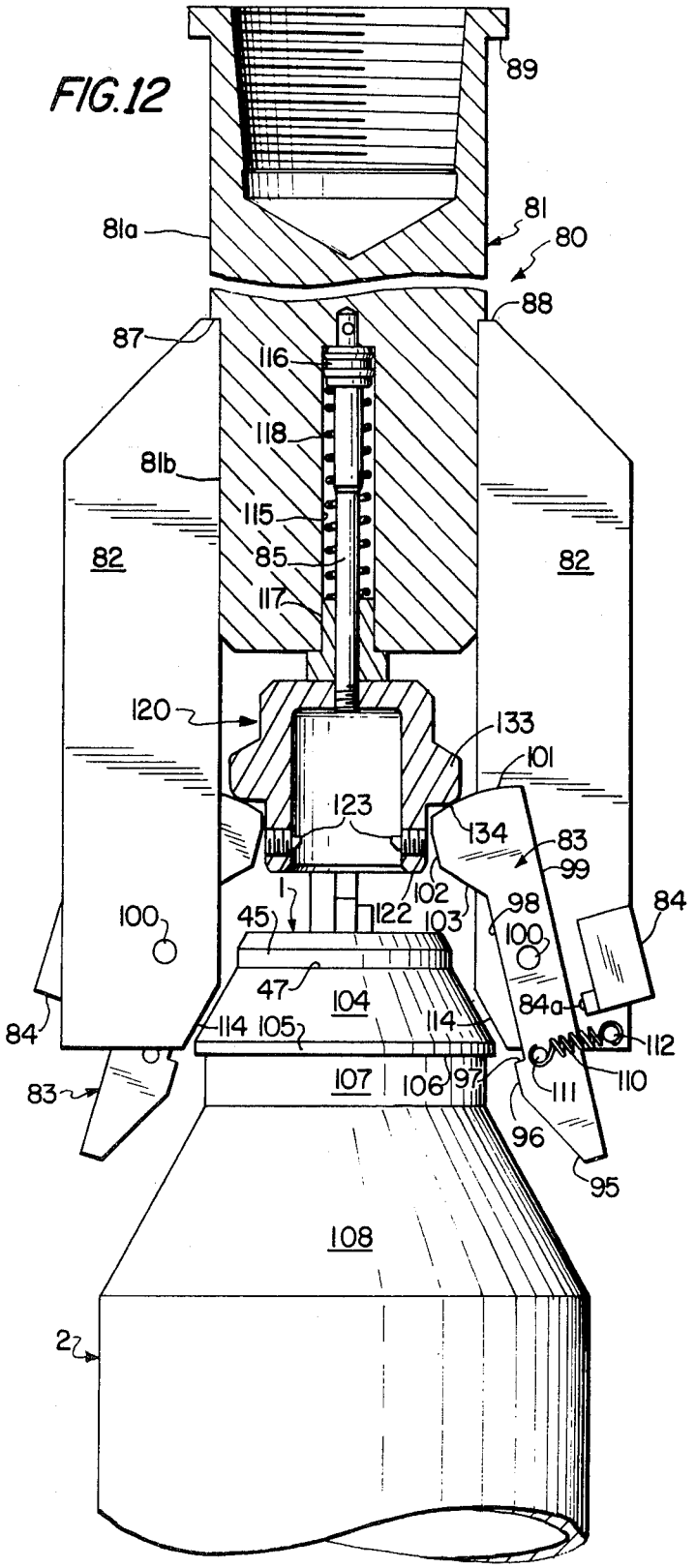
FIG. 12 is a view, partly in side elevation and partly in vertical cross section, of the handling tool of FIG. 11 being landed to retrieve the bushing of FIG. 1.

A bushing 1 constructed according to one embodiment of the invention is illustrated in FIGS. 1–8, with FIG. 1 showing the bushing installed in the top 2 of a hollow guide post and employed to anchor to the post a wire guide line 3. Bushing 1 comprises two complementary bushing members 4, 5 which are mutually identical, latch segments 6 and 7, latch segment retracting plungers 8, 9 and a ring member 10. Each member 4, 5 is generally semicylindrical and has an outer surface 11 and an inner surface 12, surfaces 11 and 12 being concentric. Surface 11 has a diameter only slightly smaller than that of the cylindrical inner surface 13 of post top 2. Surface 12 has a diameter significantly larger than that of wireline 3. Thus, the assembled bushing can be slidably received by the hollow top of the guide post, which thus serves as a socket member, and the wireline can be accommodated by the central bore defined by surfaces 12 of the two bushing members.

To accommodate the latch segment, the bushing member is provided with an arcuate transverse outwardly opening groove 14 defined by a flat upper wall 15, an inner wall 16 concentric with surfaces 11 and 12, and a flat lower wall 17. Upper wall 15 stops short of outer surface 11, the upper wall of the groove being completed by a dependent lip defined by outer surface 11 and a frustoconical surface portion 18, best seen in FIG. 5, which is concentric with surfaces 11, 12 and tapers upwardly and inwardly at, for example, 45°. Being semicylindrical each bushing member 4, 5 presents two flat longitudinally extending side edge faces 19. Each groove 14 opens through both side faces 19 of the respective bushing member.

As seen in FIGS. 4–7, each latch segment 6, 7 extends arcuately for approximately 120° and includes an inner surface 20 which is part of a right cylindrical surface having the same radius of curvature as does the inner wall 16 of each groove 14. The segment also presents flat transverse top and bottom surfaces 21 and 22, respectively, and an outer surface 23. The radial width of surface 22 is substantially smaller than that of the segment as a whole, and a frustoconical upwardly and outwardly tapering surface 24 interconnects the outer edge of surface 22 and the lower edge of surface 23. Extending upwardly from surface 24, surface 23 joins a flat transverse upper surface 25 lying in a plane spaced below surface 21 by a distance slightly greater than the axial extent of the dependent lip defined by surfaces 11, 18. Surfaces 21 and 25 are interconnected by an upwardly and inwardly tapering frustoconical shoulder 26 having a radius of curvature such as to be capable of flush engagement with surface 18.

At its midpoint, each latch segment is provided with an axial notch 27, FIG. 4, the inner wall of which includes a flat upper portion 28, which commences at the juncture between surface 21 and shoulder 26 and slants downwardly and outwardly at an angle, typically 30°, which is smaller than the angle of taper of shoulder 26, so that the upper portion of notch 27 interrupts shoulder 26. The lower portion 29 of the inner wall of notch 27 is flat and extends axially.

Since the ends of grooves 14 open through the respective side faces 19 of the respective bushing members, and since the maximum radial cross section of segments 6, 7 is uniform throughout the length of the segment and the segments are dimensioned to engage in the grooves with a sliding fit, each segment can be installed in its bushing member simply by inserting the segment endwise into the groove 14, shoulder 26 then being disposed inwardly of surface 18. To retain the segment in a lengthwise centered position in the slot, bottom wall 17 of groove 14 is provided with a radially extending groove 31, FIG. 5, for each segment and the segment is provided at its midpoint with a downwardly opening blind bore which slidably retains a retaining pin 32 urged downwardly into groove 31 by compression spring 33.

Post top 2 has a transverse annular inwardly opening groove 34 having a radial cross section conforming generally to the tip portions of segments 6 and 7, that is, to the segment portions defined by surfaces outwardly of shoulder 26. Thus, groove 34 includes a flat transverse upper wall 35, FIG. 7. The radial distance between surfaces 20 and 23 of segments 6, 7 is substantially smaller than the radial distance between inner wall 16 of groove 14 and surface 11. Accordingly, when installed in groove 14, the segment is movable between the retracted inactive position, seen in FIG. 7, and the projected active position seen in FIGS. 5 and 6. Each segment 6, 7 is yieldably biased to its active position by two helical compression springs 36 each seated in a radial blind bore opening through wall 20, the spring projecting inwardly from the segment to engage wall 16 of the groove. The active position for the segment is precisely determined by location of shoulder 26 and surface 18 and is such that, with the bushing properly located in the post top to align grooves 14 with groove 34, surface 23 of each segment is adjacent the outer wall of groove 34 and surface 25 of each segment therefore underlies upper wall 35 of groove 34 so that the bushing is restrained against upward movement relative to the post top. On the other hand, when the segments are in the inactive position shown in FIG. 7, outer surface 23 of the segment is spaced slightly inwardly from wall 13 of the post top, the segments thus being completely disengaged from groove 34 and the bushing thus freed for upward withdrawal from the post top.

In this embodiment, plungers 8, 9 are mutually identical and of the configuration shown in FIG. 8. Thus, each plunger includes a main body portion 40, of generally T-shaped transverse cross section, and a tip portion 41 which is of generally rectangular transverse cross section and has a width slightly smaller than that of segment notch 27. Each bushing member 4, 5 is provided with an elongated retaining and guiding slot 42 which extends from the upper end of the bushing member and intersects groove 14 at the midpoint of the groove. For most of its length, slot 42 is of T-shaped transverse cross section and dimensioned to slidably accommodate body portion 40 of the plunger, the portion of the slot representing the stem of the T opening through surface 11. Near groove 14, the portion of slot 42 corresponding to the cross bar of the T terminates at a shoulder 43, but the remainder of slot 42 continues and opens into slot 14, interrupting the dependent lip defined by surfaces 18 and 11. Main body portion 40 of the plunger is shorter than the length of the main portion of slot 42, and tip portion 41 of the plunger is longer than the distance between shoulder 43 and the bottom wall 17 of groove 14. Each plunger 8, 9 is slidably retained in the slot 42 of a different one of the bushing members. Tip portion 41 of the plunger is chamferred to provide a flat camming surface 44 which slants downwardly and outwardly at the same angle as does wall portion 28 of notch 27.

The upper end of each bushing member 4, 5 is provided with an outwardly extending flange portion 45, FIG. 1, which presents a downwardly facing flat transverse shoulder 46 dimensioned for flush engagement with the annular upper end face 47 of post top 2. Portion 45 is interrupted by a radial slot 48 of a width adequate to allow free passage of the upper end portion of the respective plunger. Portion 45 has an inner surface 49 which extends downwardly to join a flat transverse upper end face 50. Slot 42 and plunger body portion 40 are so dimensioned and located that a substantial part of the cross-sectional area of the upper end of the plunger is exposed inwardly of surface 49. Plungers 8, 9 are releasably retained, as by shear pins 51, FIG. 1, in raised inactive positions in which the upper ends of the plungers extend upwardly beyond the common plane of end faces 50 and camming surfaces 44 of the tip portions of the plungers lie in a plane immediately above surfaces 28 of the respective latch segments.

Ring member 10 has a right cylindrical outer surface interrupted by a transverse annular outwardly opening upper groove 52, FIG. 1, the upper side wall of that groove lying in a plane at right angles to the axis of the ring member and constituting a downwardly facing shoulder 53. Near its lower end, ring member 10 has a transverse annular outwardly opening groove 54. The inner surface 55 of the ring member is right cylindrical and of the same diameter as surfaces 12 of the bushing members. At their upper ends, bushing members 4, 5 each have a transverse arcuate inwardly projecting flange 56 dimensioned to be snugly received in groove 54 of ring member 10. Bushing members 4, 5 also each present an upwardly directed flat transverse annular shoulder 57, the two shoulders lying in a common plane when the bushing members are assembled as seen in FIG. 1, so that shoulders 57 serve as a seat for the lower end face 58 of the ring member. In the assembled device, surfaces 12 and 55 lie in the same cylindrical plane.

Bushing 1 serves both to center wireline 3 relative to post top 2 and to anchor the wireline to the post. Thus, the end of the wireline is frayed and cast conventionally in Babbitt metal within a hollow cup or "spear" 60, the spear having a cylindrical shank 61 of a diameter such as to be embraced by inner surfaces 12 of the bushing members. At its free end, shank 61 has a transverse annular outwardly projecting flange 62. At its lower end, the inner surface 12 of each bushing member has a transverse arcuate inwardly opening groove 63 dimensioned to snugly embrace flange 62 of the spear, as shown. Thus, when the two bushing members are fitted about the wireline, with flange 62 embraced by groove 63, and the bushing is then installed in the post top with latch segments 6(7) engaged in groove 34, any upward strain on the wireline is transferred from anchoring spear 60 to the bushing members and thence through the latch segments to upper wall 35 of groove 34 of the post top.

Though other retaining means can be employed, as described for example with reference to FIGS. 9 and 10, bushing members 4, 5 of this embodiment are releasably retained in the assembled positions seen in FIG. 1 by two roll pins 65, FIG. 1, engaged in respective ones of two pairs of chordally disposed bores in the bushing members. Using pins 65 in this fashion, the bushing members are completely interchangeable, i.e., are neither right-handed nor left-handed, so that problems of stocking and ordering replacement bushing members are simplified.

For initial installation of a wireline type of guidance system, a plurality (typically four) of the guide posts are part of and extend upwardly from a guide means base. With the guide means base supported on the platform or other operational base at the surface of the body of water, four wirelines 3, eight bushing members 4, 5 (each equipped with latch segments and plungers), and four ring members 10 are provided, each ring member having been placed on a different one of the wirelines before the end of the wireline is secured to its anchoring spear 60. Two of the bushing members are then fitted about the end portion of each wireline 3, with the flange 56 of each bushing member engaged in groove 54 of ring member 10 and the grooves 63 of each ring member embracing flange 62 of spear 60. Retaining pins 65 are then driven into their respective aligned pair of bores to secure the two bushing members in the assembled positions seen in FIG. 1. With plungers 8, 9 in raised positions, shear pins 51 are inserted, with the pins then engaged in coaxial bores in the respective plunger, bushing member and the lower end portion of ring member 10. Latch segments 6, 7 are urged outwardly to their active positions by springs 36. Thus assembled, each bushing 1 is lowered into a different one of the post tops 2, segments 6, 7 first being cammed into their retracted inactive positions by the camming action resulting from engagement of surfaces 24 and 47, the segments then snapping outwardly to engage in groove 34 as flange surface 46 seats on surface 47. With the wirelines thus anchored to the guide posts, the guide means base is lowered to the submerged position at which it is to be installed.

Installation or removal of the bushings can be accomplished by direct manual manipulation. Once the guide means base has been installed at, e.g., the ocean floor, recovery of the bushing must, if the depth is beyond diving range, be accomplished by remote operations. Such operations are accomplished with the aid of a handling tool, such as that shown in FIGS. 11–18.

THE EMBODIMENT OF FIGS. 9 AND 10

In a bushing otherwise as shown in FIGS. 1–8, the bushing members can be interconnected by a means including a hinge in the manner shown in FIGS. 9 and 10. Here, bushing members 70 and 71 are identical to bushing members 4 and 5, FIGS. 1–7, except that the bushing members are connected by a hinge and latch rather than being pinned. The bushing members are again identical, and are provided with a rectangular notch 72 at the top and a second notch 73 therebelow, the notches being repeated at each edge of the flat side of the bushing member. Vertical blind bores 74, threaded at their lower ends, are centered on the respective notches. A rectangular hinge block 75 is disposed in one of the notches 73 and welded along one edge to one of the bushing members, the block being of such shape and dimensions that, when the two bushing members are fitted together, one-half of the block is slidably received in the corresponding notch 73 of the other bushing member, as seen in FIG. 10. A second block is similarly provided at the opposite edge of the bushing. The portion of each block which projects from the bushing member to which it is welded has a rounded nose 76, FIG. 10, and is provided with a vertical through bore 77 which aligns with the corresponding bore 74 when the two bushing members are fitted together. To complete the hinge, a hinge pin 78 is inserted through one bore 74 and the corresponding bore 77 and threaded into place, as seen in FIG. 10. After the bushing members, thus hinged together, have been fitted around the wireline and spear, a second pin 79 is inserted through the opposite bores 74,77, as seen in FIG. 9, to latch the bushing closed.

RETRIEVAL OF BUSHING WITH HANDING TOOL OF FIGS. 11–16

So long as the wireline remains intact and its use is to be continued, there is no need for retrieving the bushing. It is when the wireline has been broken that retrieval must, of course, be accomplished without the aid of the wireline. Under such circumstances, the bushing can be retrieved by use of the handling tool 80 illustrated in FIGS. 11–19, the remnant of the broken wireline being first cut off immediately adjacent the bushing, advantageously by using a remotely operated cutting tool such as is disclosed in U.S. patent application Ser. No. 311,287, filed 1981, by William S. Cowan.

Tool 80 includes a cylindrical main body 81, four support arms 82 rigidly secured to and depending from the main body, a plurality of jaw members 83 each pivotally mounted on a different one of the support arms, a plurality of pressure fluid operated actuators 84 each mounted on a different one of the support arms for actuating the respective jaw members, and a pressure fluid operated piston rod 85, FIG. 12. Body 81 is cylindrical and equipped with internal threads at its upper end for rigid connection to a handling string 86, FIGS. 11 and 17. Arms 82 are flat, as are jaw members 83, and each jaw member is supported on the respective one of arms 82 by a pivot pin extending at right angles to the plane of the arm, so that the planes of the respective support arms and jaw members are parallel. Arms 82 extend longitudinally of body 81, the plane of each arm being spaced from the longitudinal axis of body 81 by a distance such that the plane of each jaw member 83 includes the longitudinal axis of the body.

As seen in FIG. 12, body 81 includes an upper portion **81*a* of larger outer diameter and a lower portion 81*b* of smaller outer diameter, the outer surfaces of the two portions being joined by a transverse annular downwardly facing shoulder 87. Each support arm 82 has one straight side edge extending along and welded to the surface of body portion 81*b*, and an upper end 88 abutting shoulder 87. A transverse annular outwardly projecting flange 89 is provided at the upper end of body 81, the space between flange 89 and the coplanar upper ends 88 of the support arms accommodating hub 90 of a conventional two-arm guide arm unit 91, FIG. 11. Arms 92 of the guide arm unit extend radially from hub 90, and therefore from tool 80, the arms being angularly spaced apart and pivotally mounted on body 81, as shown, each arm being provided at its free end with a ring 93 to slidably embrace one of the remaining wire guide lines of the usual four-line guidance system. It will be understood that, when one guide line of a four-line guidance system has broken, applying rings 93 to the two guide lines adjacent the broken line will assure that, when unit 91 is guided down to the underwater installation, tool 80** will automatically center on the top of the guide post to which the broken guide line is attached.

Jaw members 83 are identical and the four jaw members are so constructed and arranged as to serve both to aid in final centering of tool 80 on post top 2, as the tool is landed, and grip the post top after the tool has landed. Each jaw member includes a lower end portion which projects below the lower ends of the support arms and includes an elongated downwardly and outwardly slanting lower edge 95, a short side edge 96 and a transverse shoulder 97. Above shoulder 97, the jaw member has straight parallel side edges 98, 99 and pivot pin 100, by which the jaw member is mounted on the support arm, is approximately centered between edges 98, 99. Upper edge 101 of the jaw member extends as an arc of a circle of which the axis defined by pin 100 is the center. While side edge 99 extends for the full length of the jaw member, the upper end portion of the jaw member is enlarged on the opposite side, being defined by edge portions 102 and 103. Post top 2 includes an upper frustoconical outer surface portion 104 which tapers upwardly and inwardly to intersect end face 47, a short right cylindrical surface portion 105 at the base of portion 104, a transverse annular downwardly facing shoulder 106, a right cylindrical surface portion 107, and a second frustoconical surface portion 108 which tapers upwardly and inwardly to joint surface portion 107.

Each jaw member 83 is equipped with a helical tension spring 110 connected at one end to a pin 111 fixed to the jaw member adjacent shoulder 97 and at the other end to a pin 112 fixed to the lower end portion of the arm 82 on which the jaw member is pivoted. Springs 110 thus yieldably bias the jaw members in directions urging the lower ends outwardly and the upper ends inwardly. Jaw members 83 can thus occupy initial positions, seen in FIGS. 11 and 12, and actuated positions, seen in FIGS. 13 and 14. The configuration and dimensions of the jaw members are such that, when the jaw members occupy the initial positions, edges 96 of each opposed pair of jaw members are spaced apart by a distance slightly greater than the diameter of post top surface 105 and edges 95 slant downwardly and outwardly at an angle greater than that of surface 108. Support arms 82 are chamferred at their lower inner corners to provide surfaces 114 which slant downwardly and outwardly at the same angle as post top surface 104 so that surfaces 114 lie in a common frustoconical plane of a diameter only slightly larger than that of surface 104. Accordingly, with tool 80 having first been approximately centered relative to post top 2 by guide arm unit 91, surfaces 95 of the jaw members first act in inverted funnel fashion to more precisely align the tool with the post top and surfaces 114 then coact with surface 104, as the tool is landed, to center the tool precisely on the post top. In this regard, actual landing of the tool brings surfaces 114 into direct contact with surface 104.

When the tool has landed, pressure fluid is simultaneously supplied to all four actuators 84, causing plungers 84*a* of the actuators to be extended to engage edges 99 of the jaw members in locations spaced below pivot pins 100 and thus swinging the lower portions of the jaw members inwardly until the jaw members occupy their actuated positions, with edges 96 of the jaw members all engaging surface 107 of the post top and shoulder 97 of the jaw members spaced below shoulder 106 of the post top, the tool raising itself to bring shoulders 97 into engagement with shoulder 106.

Piston rod 85 is disposed within a cylindrical axial bore 115 which opens through the lower end face of body 81. At its upper end, rod 85 is equipped with a piston 116. The lower end of the rod extends through a bushing 117 fixed in the lower end of the bore, there being a slight clearance between the rod and the bushing to allow fluid below the piston to escape from and enter the bore as the piston moves. The rod and piston are resiliently biased to their uppermost positions, seen in FIG. 12, as by a helical compression spring 118 engaged between bushing 117 and piston 116. The lower end of rod 85 is threaded so that a retrieving member 120, FIGS. 11–16, can be attached to the rod when the tool is to be used to retrieve bushing 1, and a running member 121, FIGS. 17 and 18, can be attached when the tool is to be used for remote installation of bushing 1 in post top 2.

Retrieving member 120 comprises a rigid body having the general form of an inverted cup. The transverse wall of the body has a central through bore threaded to cooperate with the threaded end of rod 85. The cylindrical side wall of the cup has an inner diameter slightly larger than the outer diameter of ring member 10. The lower portion of the side wall has an outer diameter slightly smaller than inner surface 49 of the flange portions 45 of the two bushing members 4, 5, which make up bushing 1. The cylindrical wall of the cup presents a flat transverse annular end face 122 so dimensioned as to engage the upper end faces 50 of plungers 8, 9 of bushing 1 when retrieving member 120 moves downwardly into the annular space between portions 45 of the bushing member and ring member 10. Member 120 is equipped with at least two inwardly directed spring biased shear pins, indicated generally at 123, FIGS. 12–15, and shown in detail in FIG. 16. For each shear pin 123, the cylindrical wall of member 120 is provided with a radially extending threaded through bore 124. A cylindrical threaded plug member 125 is installed in the inner end portion of bore 124 and has a through bore 126 of hexagonal transverse cross section. A shear pin 127 of corresponding hexagonal transverse cross section is slidably disposed in bore 126, the length of the shear pin being such that, when the outer end of the shear pin projects a short distance beyond the outer face of plug member 125, the inner end of the shear pin is spaced inwardly from the cylindrical wall of member 120 adequately to engage beneath shoulder 53 of ring member 10 after tool 80 has been landed. A split washer 128 is engaged in a groove in the outer end portion of the shear pin as a stop to prevent excessive inward displacement of the shear pin relative to plug member 125. The shear pin is biased inwardly by a helical compression spring 129 having one end engaged in a recess in the shear pin and the other end seated on an outer plug member 130 which is threaded and engaged in the outer end of bore 124. The inner end portion of the shear pin has a downwardly and outwardly slanting camming face 131 disposed to engage the upper end of ring member 10 as the tool is landed, so that the shear pin is cammed outwardly to allow member 120 to pass the ring member until the shear pins can engage beneath shoulder 53. To assure freedom of movement for the shear pin, plug member 125 has a duct 132 to communicate between the interior of bore 124 between plug members 125 and 130, on the one hand, and the space within member 120, on the other hand. Shear pins 123 are thus made generally in accordance with U.S. Pat. No. 3,268,239, issued Aug. 23, 1966, to Castor et al and the disclosure in that patent is hereby incorporated by reference.

Member 120 includes a transverse annular outwardly projecting flange 133 located a significant distance above face 122 and presenting a downwardly facing shoulder 134. The outer edge of shoulder 134 is rounded, as seen at 134*a*, FIG. 13. When tool 80 is prepared for use in retrieving a bushing 1, piston 116 and rod 85 are placed in their uppermost positions, seen in FIG. 12, so that member 120 engages the lower end of bushing 117. No pressure fluid is supplied to the tool and jaw members 83 are therefore urged by springs 110 to the positions seen in FIG. 12, causing the upper end of the jaw members to swing inwardly. The positions of the jaw members and retrieving member 120 are then such that upper end surface 101 of each jaw member engages under shoulder 134 of the retrieving member, blocking the retrieving member against downward movement.

Figure 13:
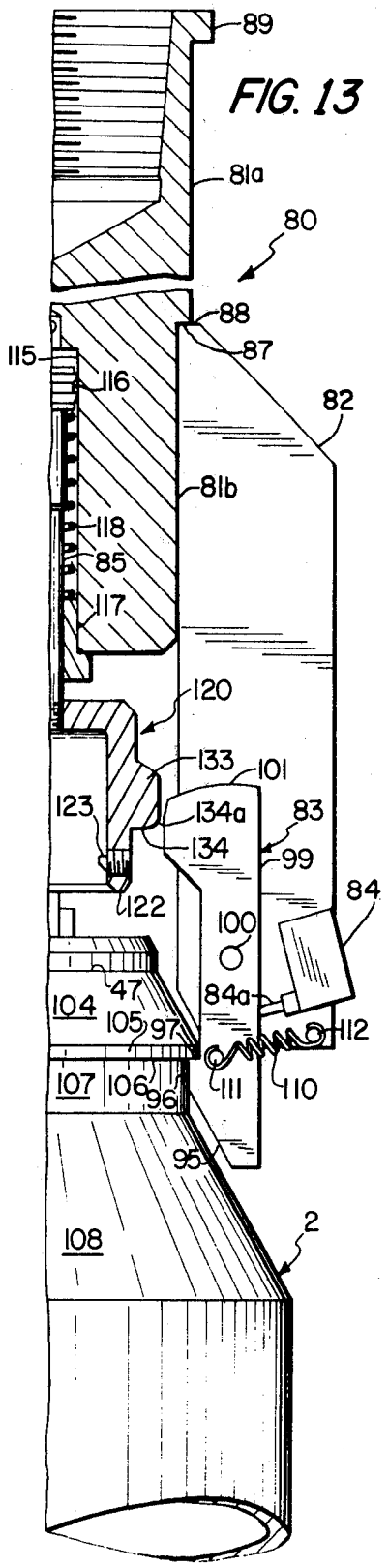
FIGS. 13–15 are views, similar to FIG. 12, illustrating successive stages of retrieval of the bushing by operation of the tool.
Figure 14:
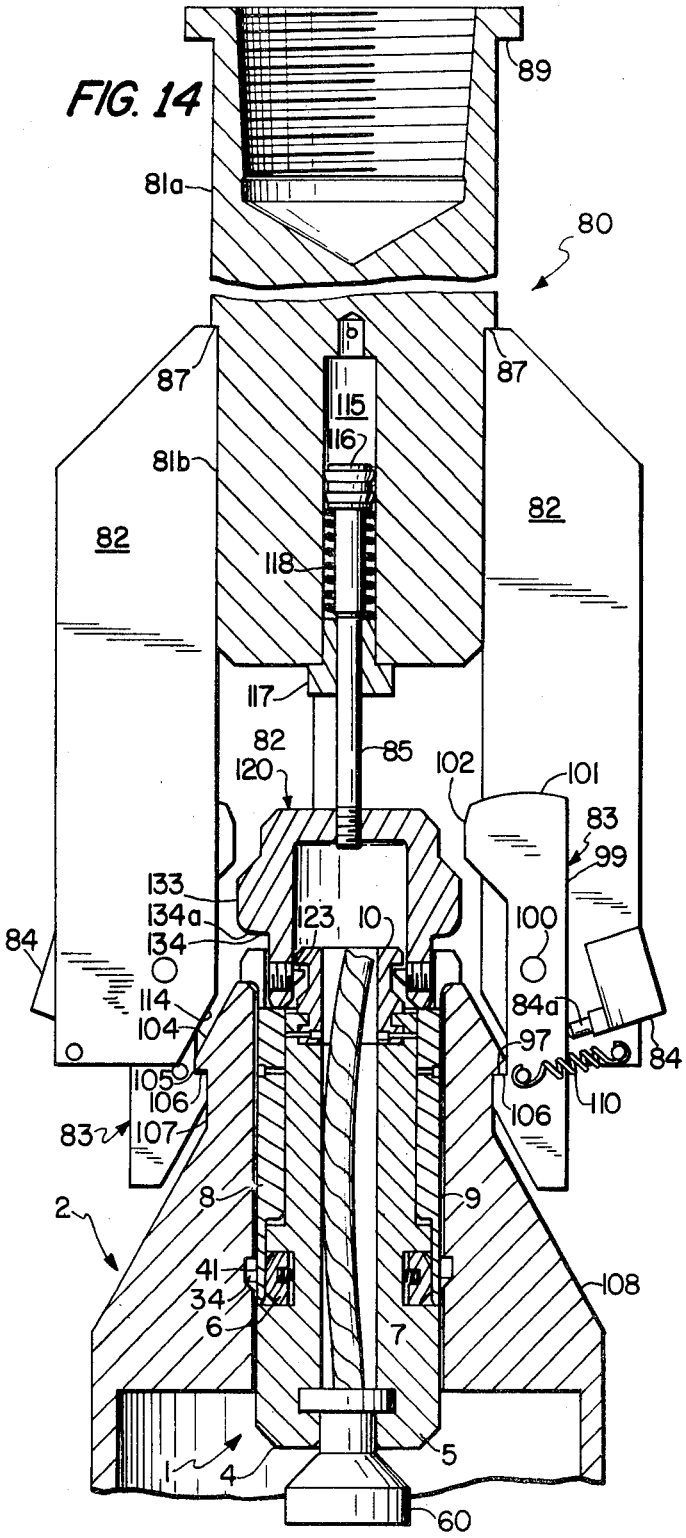
Figure 15:
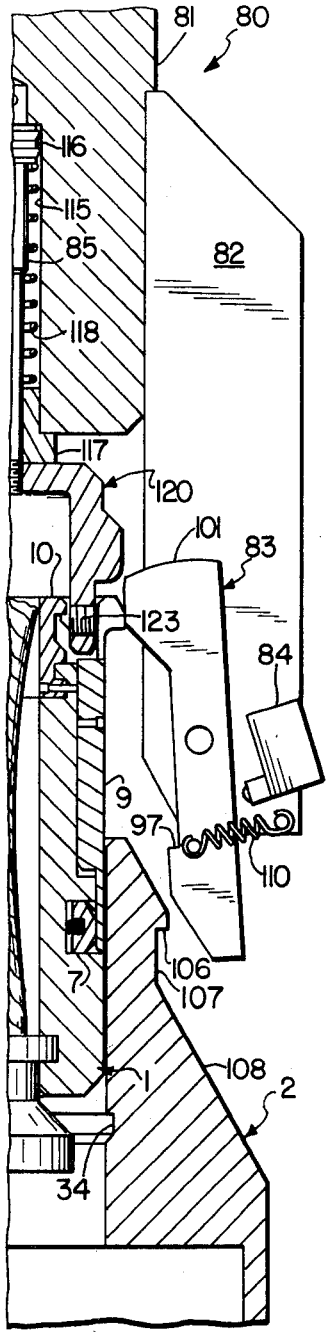

As seen in FIG. 19, pressure fluid for operating tool 80 is supplied from a source 135, located on the operational base at the surface of the body of water, via a valve 136 to the bore of handling string 86, thence to a chamber 137 in the upper end of tool body 81. A single bore 138 extends downwardly in body 81 from chamber 137 and communicates with a plurality of lateral bores 139. Each jaw member actuator 84 has its input connected, as by an external hose 140, to one of lateral bores 139, hoses 140 being omitted in FIGS. 11–15 and 17 for clarity of illustration. One bore 139 also communicates between bore 138 and the upper end of bore 115. Accordingly, the four actuators 84 and the rectilinear power device constituted by piston 116 and bore 115 are all connected in parallel to pressure fluid source 135 whenever valve 136 is opened. When the tool is in use, valve 136 remains connected to vent during the trip down and is opened only after the tool has been landed. Upon opening of the valve, and when chamber 137 and ducts 138, 139 have been pressurized, pressurization of the space in bore 115 above piston 116 cannot drive member 120 downwardly because member 120 is blocked mechanically by the upper ends of jaw members 83. But, since actuators 84 are connected in parallel with the cylinder constituted by bore 115, all four actuators 84 are energized simultaneously to drive the lower portions of jaw member 83 inwardly to grip post top 2 in the manner seen in FIG. 13 as a result of opening valve 136. As soon as jaw members 83 swing far enough toward the clamping positions to remove upper end surfaces 101 from engagement under flange 133 of member 120, the retrieving member is no longer blocked. Bore 115 having already been pressurized above piston 116, the combination of piston 116, rod 85 and member 120 begins travelling downwardly, as seen in FIG. 13, as soon as surfaces 101 disengage from flange 133, and such downward travel continues until, as seen in FIG. 14, lower end face 122 of member 120 engages upper end faces 40*a*, FIG. 8, of plungers 8, 9 and the plungers are driven downwardly to retract latch segments 6, 7 into grooves 14 and thereby free bushing 1 for removal from post top 2. As face 122 of member 120 approaches faces 50 of bushing members 4, 5 the flat upper faces of shear pins 27 come below shoulder 53 of ring member 10 and snap inwardly under the influence of springs 129, FIG. 16.

Valve 136 is now operated to shut off the pressure fluid and vent the system below the valve. The resulting depressurization of bore 115 above piston 116 allows spring 118 to re-expand, driving piston 116, rod 85 and member 120 upwardly and extracting bushing 1 from post top 2 for recovery by manipulation of the handling string. Should bushing 1 be jammed in post top 2 so tightly that the force applied by spring 118 is not adequate to extract the bushing 1, the strain on handling string 86 is increased, spring 118 then collapsing completely so that the increased strain is now applied to member 120 via rod 85, and the bushing may now be extracted as a result of the strain on the handling string. Should such extraction not occur, as when one of the segments is blocked by debris against retraction, the strain on the handling string is increased to that value which will cause shear pins 127 to shear, disengaging member 120 from ring member 10, and the tool is retrieved for reuse. In this connection, it will be noted that the portion of member 120 above flange 133 is of reduced diameter so that, with the parts in the relative positions shown in FIG. 14 and with actuators 84 depressurized, springs 110 will return jaw members 83 to inactive positions in which shoulders 97 are spaced outwardly from shoulder 106.

Though the tool has been illustrated with four support arms 82 and jaw members 83, it will be understood that three such arms and jaw members, equally spaced about the central axis, can be employed. Similarly, while fluid pressure supply for operation of the tool has been shown and described as via the bore of the handling string, such supply can be via a separate conduit extending beside the handling string, and distribution of the pressure fluid to actuators 84 and the cylinder defined by bore 115 can be via a manifold separate from body 81.

RUNNING THE BUSHING WITH THE HANDLING TOOL

Figure 17:
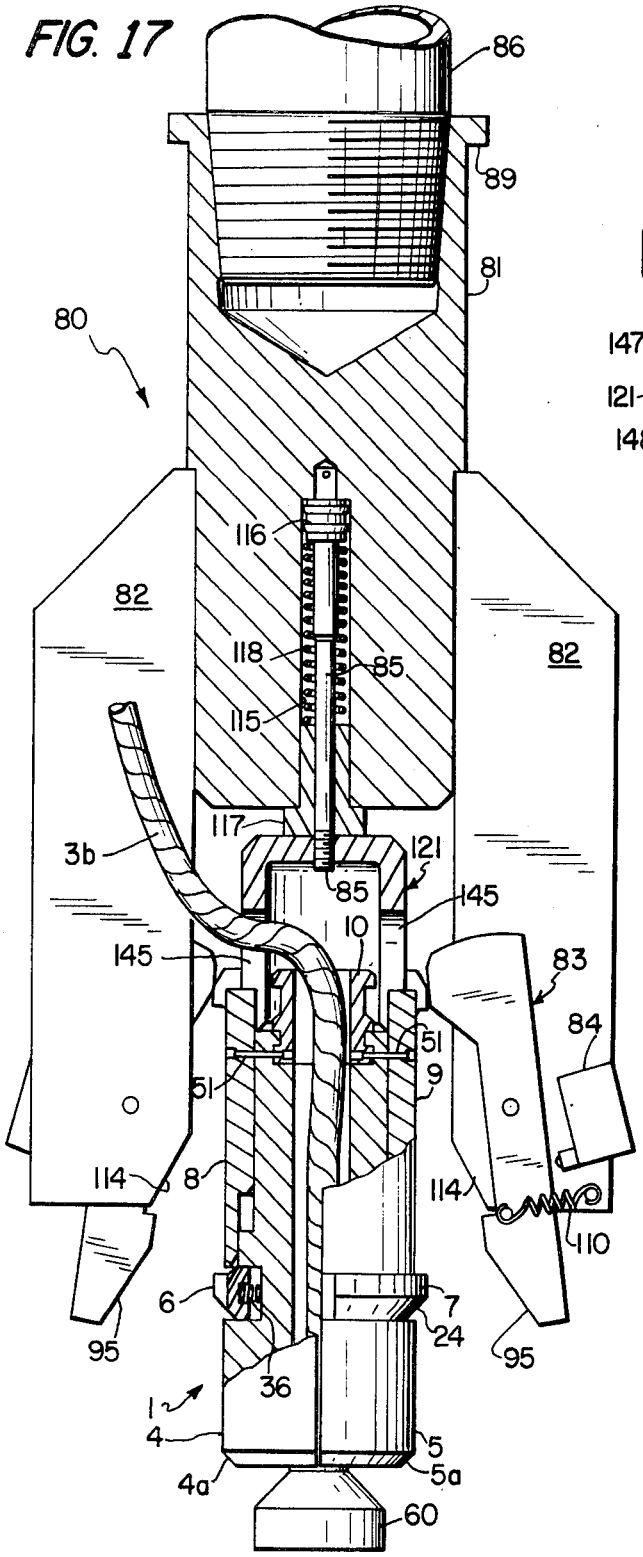
FIG. 17 is a view, partly in vertical cross section and partly in side elevation, of the tool of FIGS. 12–15 equipped with a running member for installing the bushing of FIG. 1.
Figure 18:
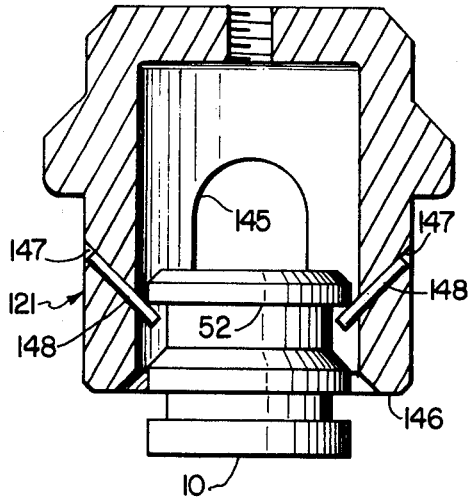
FIG. 18 is an enlarged vertical sectional view of the running member of FIG. 17.

When tool 80 is to be used to install the bushing member, as when a guide line has been broken, and the bushing retrieved as just described and applied to a new guide line 3*b*, running member 121, FIGS. 17 and 18, is employed instead of the retrieving member 120. Member 121 is an integral metal piece in the form of an inverted cup, the transverse wall being centrally bored and threaded for attachment to rod 85, the side wall having a right cylindrical inner surface and the same outer profile as described for member 120. The side wall is provided with two diametrically opposed longitudinal slots 145 which open through lower end face 146 and are of a width such that each slot 145 can freely accommodate the upper end portion of one of the plungers 8, 9 as seen in FIG. 17. At least one of the slots 145 is also wide enough to pass guide line 3*b*, FIG. 17. In locations spaced circumferentially from slots 145 and generally opposed transversely across member 121, the wide wall of that member is provided with downwardly and inwardly slanting bores 147 to accommodate shear pins 148, FIG. 18. When bushing 1 has been assembled on guide line 3*b* and member 121 has been secured to piston rod 85 of the handling tool, the bushing is connected to the tool by inserting ring member 10 into member 121, with the bushing oriented to align members 8, 9 with slots 145 and with guide line 3*b* traversing one of the slots in the manner seen in FIG. 17, the operator observing the position of ring member 10 to be sure shoulder 52 of the ring member is above the inner ends of bores 147. Shear pins 148 are then inserted in bores 147 and driven inwardly until engaged under shoulder 52 in the manner seen in FIG. 18. Since plungers 8, 9 are held in their raised inactive positions by shear pins 51, latch segments 6, 7 occupy their outer, latching positions, being urged thereto by springs 36.

Again employing guide unit 91, FIG. 11, the tool and bushing are guided down to the post top, with the new guide line 3*b* being paid out as the tool is run down. During the trip down, valve 136, FIG. 19, is maintained in its position connecting bore 138 to vent, so that pressure fluid is not supplied to the tool. When bushing 1 reaches the post top, frustoconical lower end surfaces 4*a*, 5*a* of the bushing coact with the upper end of the post top to guide the bushing into bore 13, FIG. 1. As the bushing descends in the post top, edges 114 of arms 82 of the tool land on surface 104 of the post top. Valve 136 is then operated to supply pressure fluid simultaneously to actuators 84 and bore 115 so that jaw members 83 are swung by the actuators to latched position and rod 85 is driven downwardly to move the bushing to its fully inserted position in the post top.

When bushing 1 descends in the post top, lower faces 24 of latch segments 6, 7 engage the post top and cam the latch segments inwardly to their recessed positions. When the bushing has been fully inserted into the post top, so that the latch segments are aligned with groove 34, FIGS. 1, 6 and 7, springs 36 drive the latch segments outwardly to their active positions, latching the bushing in place. That the bushing has been latched is determined by first operating valve 136 to vent, so as to allow springs 110 to swing jaw members 83 to their unlatched positions, and then applying a slight upward strain to the handling string, the strain being resisted by the latch segments. With valve 136 still in its vent position, the strain on the handling string is increased to shear the pins 148, and the tool is retrieved.

What is claimed is:

1. In a remotely operated handling tool for retrieving and installing an underwater device which is releasably latched in a hollow member when installed under water, the combination of a tool body attachable to a handling string and having a central axis aligned with the handling string when so attached; a plurality of jaw members each carried by the body for movement between an inactive position and an active position, the jaw members depending from the body and being circumferentially spaced about said central axis, the jaw members having portions constructed and arranged to operatively engage the hollow member when the jaw members are actuated to their active positions while the body is in a predetermined position relative to the hollow member;

downwardly directed locator means carried by the body and constructed and arranged for engagement with the hollow member to position the body in said predetermined position as the tool is landed;

remotely operable actuating means for moving the jaw members simultaneously from their inactive positions to their active positions to secure the tool body to the hollow member when the tool body is in said predetermined position; and additional means depending from the body in alignment with said central axis and by which the underwater device to be retrieved or installed can be connected to the body.

2. The combination defined in claim 1, wherein the tool body has a cylinder bore concentric with said central axis; and the additional means comprises a piston rod equipped at one end with a piston operatively disposed in the cylinder bore, the piston rod including an end portion which projects from the body and to which a connector can be attached.

3. The combination defined in claim 2, wherein the remotely operated actuating means for moving the jaw members to their active positions includes a plurality of fluid pressure operated power devices each operatively associated with a different one of the jaw members.

4. The combination defined in claim 3 and further comprising yieldable means associated with the jaw members and biasing the jaw members to their inactive positions.

5. The combination defined in claim 2 wherein the tool is to be used to retrieve and install underwater devices including latch retracting means exposed in an area concentric with a transverse annular shoulder, wherein the additional means further comprises a connector member secured to the projecting end of the piston rod and including an end face directed away from the tool body and constructed and arranged to engage the latch retracting means of the underwater device, and means carried by the connector member for engaging the transverse shoulder of the underwater device to secure the tool against movement away from the underwater device.

6. The combination defined in claim 5, wherein the connector member is generaly cup-shaped and the end face is presented by the free end of the side wall of the cup.

7. The combination defined in claim 6, wherein the means for engaging the shoulder of the underwater device includes a plurality of shear pins carried by the side wall of the cup-shaped connector member and each yieldably biased to a shoulder-engaging position.

8. The combination defined in claim 7, wherein the shear pins project inwardly from the side wall when in their shoulder-engaging positions.

9. The combination defined in claim 5, wherein the jaw members include portions blocking the connector member against movement away from the tool body so long as the jaw members occupy their inactive positions, movement of the jaw members to their active positions leaving the connector member free for movement away from the tool body.

10. The combination defined in claim 9, wherein the remotely operated actuating means for moving the jaw members to their active positions is constructed and arranged to be operated by fluid pressure; and the combination further includes means for connecting the remotely operated actuating means for the jaw members and the cylinder bore in parallel to the same source of pressure fluid.

11. The combination defined in claim 9, wherein the connector member is generally cup-shaped and includes shoulder means located intermediate the ends of the side wall of the cup and facing away from the tool body;

the jaw members are each mounted for swinging movement about a pivotal axis intermediate the ends of the jaw member; and one end portion of each jaw member is constructed to engage the shoulder means of the connector member when the jaw member is in its inactive position and the connector member is in a position adjacent the tool body.

12. The combination defined in claim 11 and further comprising yieldable means associated with the jaw members and biasing the jaw members to their inactive positions.

13. The combination defined in claim 12 and further comprising yieldable means biasing the combination of the piston rod and piston away from the end of the tool body through which the rod projects.

14. The combination defined in claim 1 and further comprising a plurality of support arms rigidly secured to the tool body, spaced circumferentially about said central axis and projecting away from the tool body;

each of said jaw members being pivotally mounted on a different one of the support arms.

15. The combination defined in claim 14, wherein the remotely operable actuating means comprises a plurality of fluid pressure operated plunger devices each mounted on a different one of the support arms adjacent the corresponding jaw member.

16. The combination defined in claim 15, wherein the support arms each present a flat surface parallel to said central axis;

the jaw members are each mounted for pivotal movement about an axis normal to the flat surface of the arm which carries the jaw member;

each fluid pressure operated plunger device is mounted with its plunger oriented to travel parallel to the flat surface of the support arm and to engage the jaw member at a point spaced from the axis of pivotal movement of the jaw member.

17. In a remotely operated handling tool for manipulating an underwater device, the combination of a tool body;

first fluid pressure operated means carried by the tool body and remotely actuatable from a first condition to a second condition to perform a first desired function; second fluid pressure operated means carried by the tool body and movable from a first position relative to the tool body to a second position to perform at least one additional function, at least a portion of the first fluid pressure operated means being so constructed and arranged as to mechanically block the second fluid pressure operated means from movement to its second position only when the first fluid pressure operated means is in its first condition;

means for supplying pressure fluid simultaneously to the first and second fluid pressure operated means, whereby the first fluid pressure operated means is actuated from its first condition to its second condition, with resultant unblocking of the second fluid pressure operated means, and the second fluid pressure operated means if then actuated from its first position to its second position.

18. The combination defined in claim 17, wherein the first fluid pressure operated means constitutes a gripping device and comprises a plurality of movable jaw members which occupy an inactive position when the first fluid pressure operated means is in the first condition and a second position when the fluid pressure operated device is in the second condition, at least one of the jaw members being constructed and arranged to mechanically block the second fluid pressure operated means when the at least one jaw member occupies its inactive position.

* * * * *